United States Patent [19]

Bianchi

[11] Patent Number: 4,976,057

[45] Date of Patent: Dec. 11, 1990

[54] SIMULATED NEON SIGN

[76] Inventor: Dennis R. Bianchi, 4365 Woodglen Dr., Moorpark, Calif. 93021

[21] Appl. No.: 222,027

[22] Filed: Jul. 21, 1988

[51] Int. Cl.[5] ..... G09F 13/06

[52] U.S. Cl. ..... 40/579; 40/545; 40/550

[58] Field of Search ..... 40/543, 545, 550, 551, 40/564, 581, 616, 552, 579

[56] References Cited

U.S. PATENT DOCUMENTS

| | | | |
|---|---|---|---|
| 1,785,341 | 12/1930 | Fisher | 40/579 |
| 1,839,534 | 1/1932 | Cole | 40/579 |
| 1,847,534 | 3/1932 | Neuhut et al. | 40/579 |
| 2,062,887 | 12/1936 | Karst . | |
| 2,106,031 | 1/1938 | Kloner . | |
| 2,362,157 | 11/1944 | Quill . | |
| 2,486,859 | 11/1949 | Kerkhof . | |
| 3,978,599 | 9/1976 | Berger . | |
| 4,077,146 | 3/1978 | Nagowitz . | |
| 4,373,283 | 2/1983 | Swartz . | |
| 4,601,120 | 7/1986 | Levin | 40/550 |

FOREIGN PATENT DOCUMENTS

| | | | |
|---|---|---|---|
| 481400 | 8/1929 | Fed. Rep. of Germany | 40/545 |

*Primary Examiner*—Cary E. Stone

*Attorney, Agent, or Firm*—Lyon & Lyon

[57] ABSTRACT

There is disclosed herein a new form of sign or graphic display which simulates a neon sign. The same comprises a hollow tube or tubes which are formed into desired shapes, such as letters, graphics and the like. These tubes are lit along the side edge by directing illumination to the side thereof, preferably through colored material, paint or dye to provide a colored display. Several arrangements for illuminating the sides of the tubes are disclosed. In the case of flexible vinyl tubing, a method is disclosed for forming the same into the desired shapes by inserting a solid Teflon rod in the tube prior to bending, bending the tube to the desired form, and applying suitable heat in order that the tube will assume the desired shape, then cooling the tubing and removing the solid rod.

9 Claims, 2 Drawing Sheets

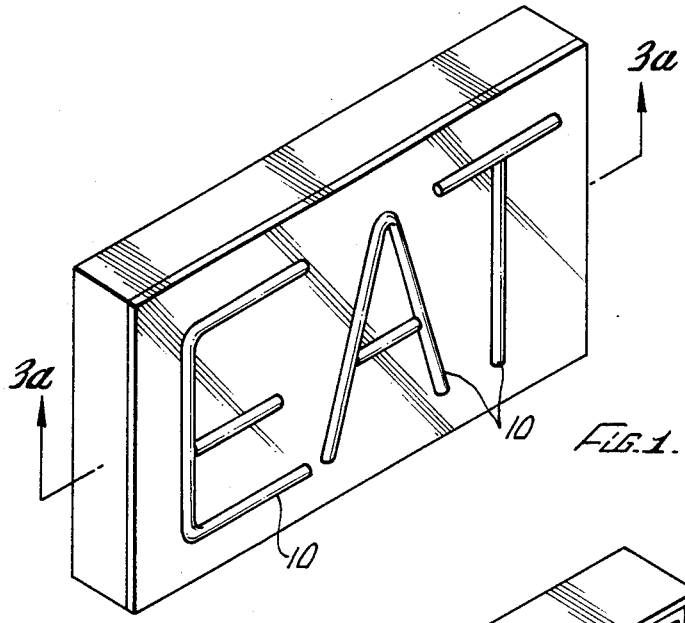
FIG. 1.
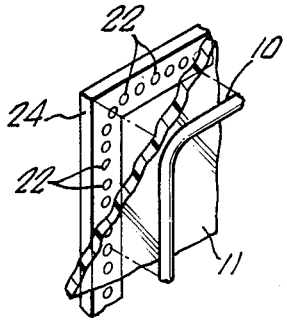
FIG. 3B.
FIG. 2.
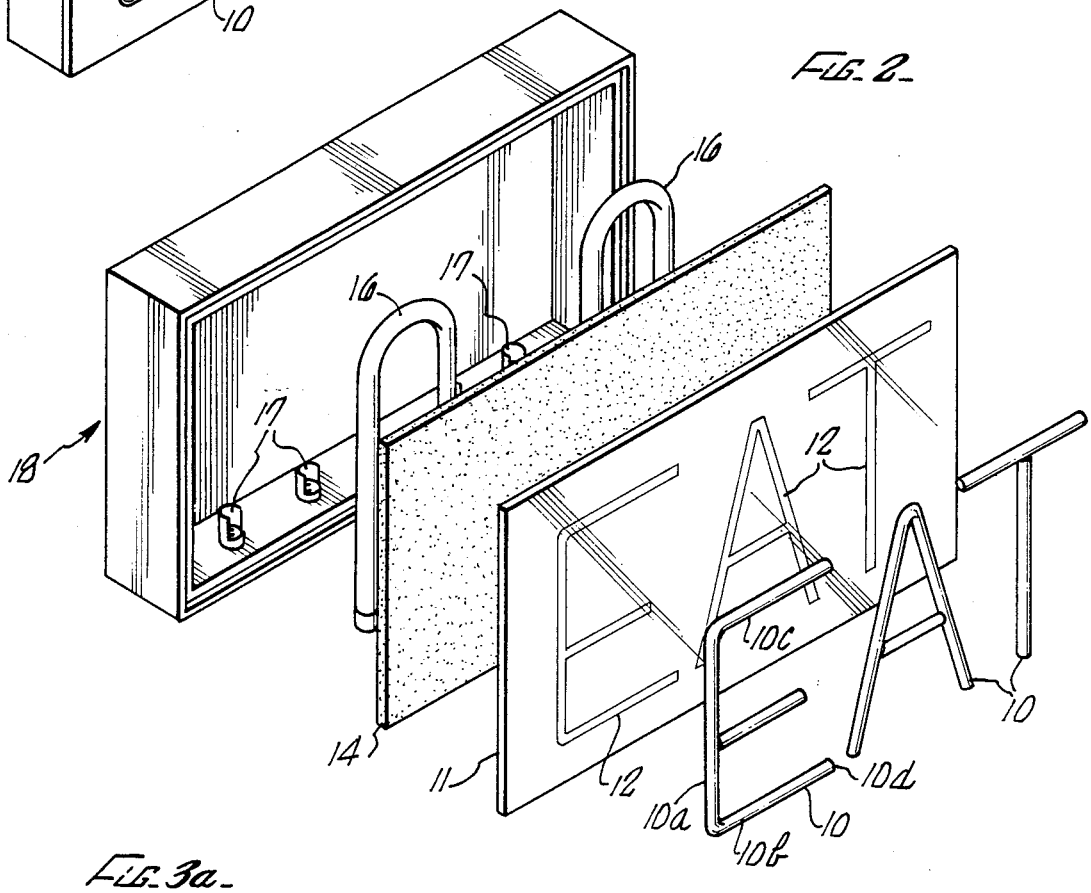
FIG. 3a.
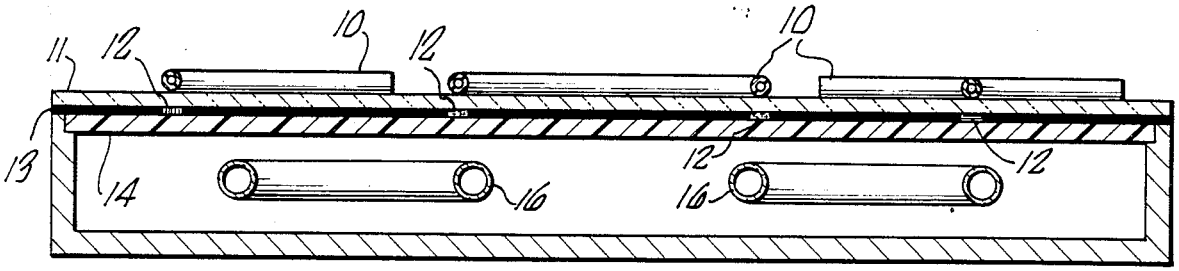

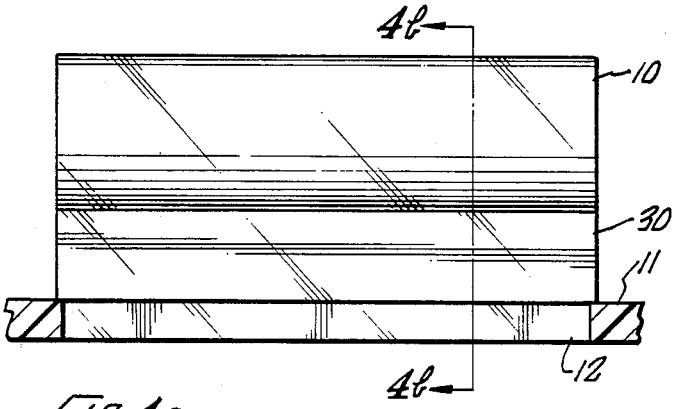
FIG. 4a.
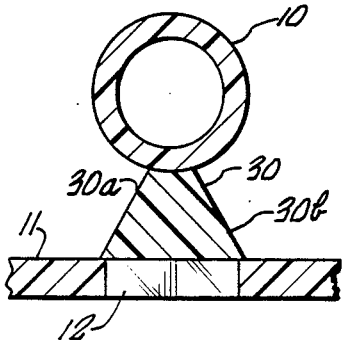
FIG. 4b.
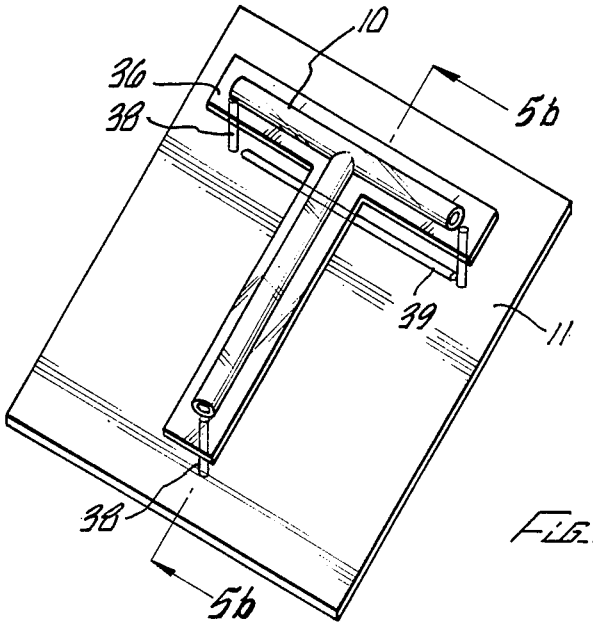
FIG. 5a.
FIG. 5b.
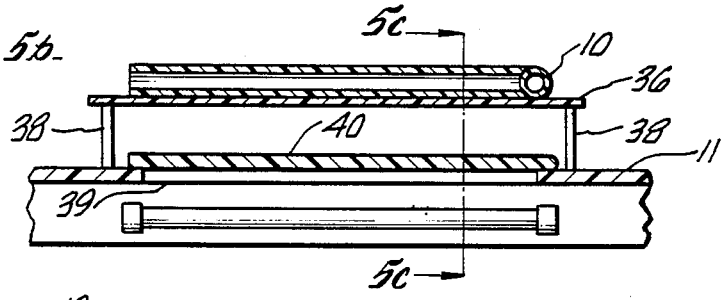
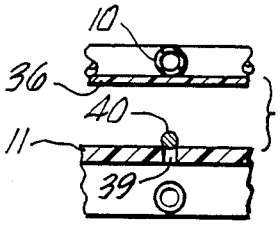
FIG. 5c.

SIMULATED NEON SIGN

BACKGROUND OF THE INVENTION

The present invention relates to illuminated signs, and more particularly to a sign of this nature which has the appearance of a neon sign.

Neon signs have been widely used over the years and apparently were originally developed by the French chemist Georges Claude in the early 1900's. These signs became immensely popular in the United States but after World War II, Plexiglas signs became popular and the interest in neon sign waned. However, in recent years their popularity has again increased for use as advertising signs, point of purchase displays and, not insignificantly, for decor, architectural accent and art objects.

While neon signs and graphics can produce relatively brilliant light of numerous colors, they are expensive to produce. Various attempts have been made to produce simulated neon displays Examples are U.S. Pat. No. 4,077,146 and U.S. Pat. No. 4,373,283. The former shows a point of purchase display device made of generally transparent material having raised portions forming a predetermined pattern. Areas other than the pattern are painted black, and light shines through the transparent pattern portion to give the general visual effect of a neon sign. The latter U.S. Pat. No. 4,373,283 includes a printed pattern simulating a neon tube or tubes which is backlit to provide the display. Other examples of illuminated displays or advertising signs are found in U.S. Pat. No. 3,978,599, 2,062,887, 2,362,157 and U.S. Pat. No. 2,486,859 which show various forms of either back or front lit letters providing displays. While some of these sign and display devices have found acceptance, they do not have an appearance sufficiently like a neon sign to convey the neon sign impression. Additionally, some suffer from the disadvantages of not providing a sufficient range of colors, not having the clear tubular appearance of neon, not being sufficiently bright, and having a rather flat appearance.

According to the present invention, on the other hand, there is provided an improved form of sign which provides a more realistic simulation of a typical neon sign. It does not have the complexity or cost of a neon sign, but has the basic appearance of a neon sign and, while not as bright as neon, comes close to simulating the usual neon sign.

SUMMARY OF THE INVENTION

According to an exemplary embodiment of the present invention, the simulated neon sign can be provided by lighting the side of a hollow tube which has been bent into the desired shape or shapes to form the letters or other graphic configurations desired. In a typical exemplary embodiment, a clear or colored flexible hollow vinyl tubing is bent into the desired shape and secured by an adhesive to a panel which usually is a clear plastic panel. The panel may have either open, transparent or translucent areas corresponding to the shape of the bent hollow tubing, and the other areas of the panel preferably are black or opaque. The panel is lit from the rear by a suitable source or sources. Different colors can be provided by coloring the area of the panel behind the tubing in any suitable manner as by applying colored sheet material, paint, dye or the like.

In addition, a method of bending flexible vinyl tubing and the like according to the present invention comprises the steps of inserting a hollow rod of a material such as Teflon into the tubing, bending the tubing under suitable heat, cooling the tubing, and removing the rod. In this manner, bent areas and corners remain smooth and not kinked and provide a clean appearance, much more like a neon tube. Alternative arrangements for the hollow tubing, support and illumination thereof are disclosed.

Accordingly, it is a principal object of the present invention to provide a new form of display which simulates a neon display.

Another object of this invention is to provide an

A further object of this invention is to provide a new form of display which uses hollow tubing lit along a side edge thereof.

Another object of this invention is to provide an improved method of forming or bending hollow plastic tubing for signs and displays.

BRIEF DESCRIPTION OF THE DRAWINGS

These and other objects and features of the present invention will become better understood through a consideration of the following description, taken in conjunction with the drawings in which:

FIG. 1 is a perspective view of an exemplary sign according to the present invention;

FIG. 2 is an exploded view of the sign of FIG. 1;

FIG. 3*a* is a cross-sectional view of the sign taken along a line 3*a*—3*a* of FIG. 1, and FIG. 3*b* shows an alternative lighting arrangement using LEDs;

FIGS. 4*a* and 4*b* are cross-sectional views of a section of the sign according to an alternative embodiment; and FIGS. 5*a* through 5*c* are respectively a partial perspective view (FIG. 5*a*), and cross-sectional views (FIG. 5*b*—5*c*) of another alternative embodiment.

DESCRIPTION OF THE PREFERRED EMBODIMENTS

Turning now to the drawings, and first to FIGS. 1 through 3, a first exemplary embodiment of the present invention is shown. The sign comprises hollow plastic tubing 10 formed in any suitable shape, and in the case shown is formed as the letters "EAT." This tubing 10 is secured to a plastic sheet or panel 11 with a suitable adhesive such as epoxy. The sheet 11 includes typically clear areas 12 co-extensive with the shape of the tubing 10, and the rest of the sheet is coated with a suitable paint 13 or the like to render the same opaque. The areas 12 may be colored by using colored Mylar strips of material, or the areas 12 may be colored with a colored paint, dye or the like. In the construction as best seen in FIG. 3, the tubing 10 is adhesively secured to the outer face of the panel 11, and the underside of the panel 11 is painted black at 13, with colored Mylar strips being provided in the areas 12 behind tubing 10. A light diffuser 14 preferably is provided behind the panel 11 for diffusing the light from a light source which, as shown, is in the form of a pair of fluorescent tubes 16. These tubes 16 are connected to appropriate electrical sockets 17 mounted in a box or housing 18 to which the diffuser 14, and panel 11 are secured in any suitable manner as by gluing, screw fasteners, or the like.

As will be apparent from the foregoing description and FIGS. 1 through 3, light from the fluorescent tubes 16 is diffused by the diffuser 14 and passes through the Mylar strips 12 and the clear plastic panel 11 in front of the strips 12 to impinge upon the edge of the tubes 10 forming the letters "EAT." Since the remainder of the back of the clear plastic panel 11 is painted black as indicated at 13, the light only shines from the tubes through the colored areas 12. As noted above, the colored areas 12 can be provided by colored Mylar strips, colored paint, colored dye and the like, and the plastic tubing 10 is glued or epoxyed to the surface of the panel 11 directly over the colored strips 12.

In the manufacture of the panel 11 and tubing 10, the back side of the plastic 11 is painted black except for the areas of the letters, and these letter areas remain clear. For example, the clear areas can be masked before the panel is painted. These clear areas are painted, dyed or overlayed with the colored Mylar strips to provide the color desired. Then, the plastic tubing 10 is glued to the front surface of the plastic sheet 11 overlying the colored areas 12. In this manner, the clear plastic tubing 10 can thus be lit through the colored areas 12 by the fluorescent tubes to simulate a neon sign.

Additionally, a new method of bending the thing 10 so as to eliminate kinks and the like forms part of the present inventive concepts, in the case of hollow vinyl plastic tubing and similar hollow flexible tubing This is accomplished by using a solid Teflon rod inside the vinyl tube 10, placing this assembly in a form having the desired shape (e.g., the side 10*a* and legs 10*b*–10*c* of the letter "E"). This form may be one which is provided by routing the desired shape in wood or aluminum so as to hold the tubing 10 in the desired shape during heating. The tubing and Teflon rod are then heated to approximately 350° Fahrenheit for approximately one minute, as in a conventional kitchen oven, then cooled by refrigeration, as in a kitchen freezer, for approximately 30 seconds to one minute The thus-formed letter or part of a letter is pulled out of the mold, and the Teflon rod is removed The temperature selected is sufficiently high to cause the tube 10 to attain the selected shape, but sufficiently low that the Teflon rod does not assume the bent shape. The letters (e.g., "EAT") are then adhesively bonded to the front surface of the panel 11. This can be accomplished by putting the letters in a routed mold, applying a suitable adhesive, such as vinyl welding adhesive in the case of vinyl tubing 10, to the edge of the letters which will contact the panel 11, and then laying the panel 11 on the thus glued letters and applying suitable pressure for an appropriate setting time (e.g., five minutes in the case of vinyl tubing 10, vinyl sheeting 11, and vinyl welding adhesive). The color is added as noted earlier by applying the same to the backside of the panel 11 at 12, and the remainder of the backside 11 is made opaque in any suitable manner, as by painting, or the like prior to adding the color or afterwards. Alternatively, the backside of the panel 11 can be left clear where the entire back of the panel 11 is not flooded by light, such as through the use of LEDs arranged in the shape of the letters (FIG. 6), or through the use of a lens formed by a bar or rod which directs light to the tubing (FIGS. 4 and 5) as will be discussed later.

An arrangement for illuminating a letter with light emitting diodes (LEDs) is illustrated in FIG. 3*b*. In this case, a plurality of LEDs 22 are mounted in a box or container 24 having a shape like that of the letter to be illuminated and arranged behind the sheet 11 on which the tubing 10 is secured. In this case, the sheet 11 can be clear throughout if desired, although it is desirable to black out the section of the sheet 11 adjacent the LEDs so as to block from view the box 24 while still leaving a transparent area directly behind the tubing 10 through which light from the LEDs 22 can shine to illuminate the edge of the tubing 10. The LEDs used can be any color desired, and the colored sheet 12 omitted. As another lighting alternative, fiber optics and polyethylene foam can be used.

In the case of vinyl tubing 10, it is known that ultraviolet light drys out and deteriorates the tubing. In the case of use of this tubing, a UV filter cover or other suitable cover can be used over the face of the sign as seen in FIG. 1.

A box can be provided for each letter rather than a single box 18 for a group of letters if desired.

In the case of vinyl tubing 10 and similar hollow flexible tubing, the principal concept of the present invention is that the same is illuminated along its side or edge, as distinguished from at the ends thereof. The illumination, whether by fluorescent tubes, LEDs or other sources is suitably confined basically to the shape of the letter involved. This is accomplished as shown in FIGS. 1 through 3*a* by backlighting a panel 11 which has a colored, transparent or translucent areas 12 coextensive with the letters involved. Alternatively, the light can be confined as by LEDs 22 in a box 24 as shown in FIG. 3*a*. It is important that the tubing 10 comprise hollow tubing, that is 360° hollow tubing inasmuch as the same traps light and bounces it around in the hollow tube as contrasted to the disbursion which takes place in a solid rod. The tubing 10 preferably is transparent, but it can be translucent, and it can be formed in any desired shape to provide letters, graphics and other visual effects. Preferably, caps are provided at the ends of the letters as at 10*d* and FIG. 2. The tubing 10 can be colored if desired in which case it can be seen and read even when not illuminated.

Firm or hard tubing, such as hollow acrylic tubing also can be used, and even glass if desired, but it is important that the tubing be hollow and in a complete 360° circle rather than with a slot along the side of the tubing creating a longitudinal opening edge.

Turning now to the arrangement of FIG. 4, the same illustrates an alternative way of edge lighting the tube 10 by employing a suitable solid acrylic or vinyl rod or post 30. This post preferably has a triangular or trapezoidal shape as shown in FIG. 4*b*, and serves the function of a lens to direct the light from the area 12 to the side edge of the tube 10. The post 30 can be any suitable height, and in the example shown in FIG. 4 has a base width of approximately one inch wide, a height of approximately one inch, and a top edge of approximately 1/16 to ¼ inch wide. It may be formed of acrylic, clear vinyl or polyethylene foam. Preferably, the sides 30*a* and 30*b* are painted black to minimize stray light emanating therefrom. The underside of the post 12 can be illuminated through area 12 by the fluorescent tubes 16, or by the other suitable means (e.g., LEDs, fiber optics, and so forth) discussed herein.

FIG. 5 shows another embodiment which provides a display wherein the letter or graphics appear to be free-floating or projected out into space. In this embodiment, the tube 10 is adhesively bonded to a sheet top 36 rather than to the panel 11, and the sheet 36 is cut in the form of the letter of the tube 10 ("S" as seen in FIG. 5*a*), the sheet 36 is spaced from the panel 11 by suitable spacers 38. The panel 11 preferably has a hole or slot 39 cut or formed therein of the same shape as the letter, and a solid rod 40 is disposed over the opening 39 to help direct or focus light from the light source 16 to the tubing 10. The rod 40 may be a cylindrical solid rod as shown, or the same may have an elongated upstanding shape similar to that of 30 in FIG. 4 but sufficiently tall so as to extend upwardly to the bottom of the sheet 36 so as to better direct light to the edge of the tube 10.

While embodiments of the present invention have been shown and described, various modifications may be made without departing from the scope of the present invention, and all such modifications and equivalents are intended to be covered.

What is claimed is:

1. A display comprising tubing formed into a desired shape such as a letter, graphics or the like, said tubing comprising hollow tubing substantially in the form of an open 360° hollow cylinder having ends and an elongated side, and illumination means for lighting the tubing along the side thereof; and said tubing being adhesively bonded to a panel in the form of a sheet, said panel having a colored area thereon having a configuration co-extensive with the shape of the tubing, said illumination means being disposed on a side of said sheet to supply illumination to and through the colored area to the tubing.

2. A display as in claim 1 wherein a diffuser is disposed between said illumination means and said panel.

3. A display as in claim 2 wherein said illumination means comprises a fluorescent light source.

4. A display comprising tubing formed into a desired shape such as a letter, graphics or the like, said tubing comprising hollow tubing substantially in the form of an open 360° hollow cylinder having ends and an elongated side, and illumination means for lighting the tubing along the side thereof and said illumination means including a plastic lens configured substantially in the shape of said tubing.

5. A display comprising tubing formed into a desired shape such as a letter, graphics or the like, said tubing comprising hollow tubing substantially in the form of an open 360° hollow cylinder having ends and an elongated side, and illumination means for lighting the tubing along the side thereof, said tubing being adhesively bonded to a plastic sheet, said plastic sheet being mounted on and spaced from a plastic panel, said plastic panel including lens means formed substantially in the shape of said tubing, and said illumination means being disposed on one side of said lens means and said tubing and sheet being disposed on the other side thereof.

6. A display comprising tubing formed into a desired shape such as a letter, graphics or the like, comprising tubing substantially in the form of an open hollow cylinder having ends and an elongated side, and said tubing being adhesively bonded to a plastic sheet, said plastic sheet is mounted on and spaced from a plastic panel, said plastic panel includes lens means formed substantially in the shape of said tubing, and illumination means for lighting the tubing along the side thereof, said illumination means being disposed on one side of said lens means and said tubing and sheet being disposed on the other side thereof.

7. A display comprising tubing formed into a desired shape such as a letter, graphics or the like, comprising tubing substantially in the form of an open hollow cylinder having ends and an elongated side and said tubing being adhesively bonded to a panel in the form of a sheet, said panel having a colored area thereon having a configuration co-extensive with the shape of the tubing, and illumination means for lighting the tubing along the side thereof, said illumination means being disposed on a side of said sheet to supply illumination to and through the colored area to the tubing.

8. A display as in claim 7 wherein said tubing is hollow vinyl tubing.

9. A display as in claim 7 wherein said tubing is hollow acrylic tubing.

* * * * *